United States Patent [19]

Gooray

[11] Patent Number: 5,028,959

[45] Date of Patent: Jul. 2, 1991

[54] VACUUM COLLECTION SYSTEM FOR DIRT MANAGEMENT

[75] Inventor: Arthur M. Gooray, Penfield, N.Y.

[73] Assignee: Xerox Corporation, Stamford, Conn.

[21] Appl. No.: 288,193

[22] Filed: Dec. 22, 1988

[51] Int. Cl.[5] ..... G03G 21/00

[52] U.S. Cl. ..... 355/215; 15/1.51; 355/296; 355/303

[58] Field of Search ..... 355/30, 215, 296, 301, 355/303; 15/1.5, 256.51, 256.52, 301, 308, 309; 118/652

[56] References Cited

U.S. PATENT DOCUMENTS

| | | | |
|---|---|---|---|
| 3,685,485 | 8/1972 | Kutsuwada et al. | 355/215 X |
| 3,850,521 | 10/1974 | Saupe | 355/215 |
| 3,936,184 | 2/1976 | Tanaka et al. | 355/215 |
| 3,969,785 | 7/1976 | Ogawa et al. | 15/301 |
| 4,093,368 | 6/1978 | Nishikawa | 355/215 X |
| 4,154,521 | 5/1979 | Tanaka | 355/30 X |
| 4,165,171 | 8/1979 | Lemmen | 355/215 X |
| 4,260,235 | 4/1981 | Stack | 355/296 X |
| 4,610,534 | 8/1986 | Ito et al. | 355/304 |
| 4,666,282 | 5/1987 | Rowe | 355/215 |
| 4,680,040 | 7/1987 | Gooray et al. | 55/387 |
| 4,878,657 | 11/1989 | Ura et al. | 355/215 X |

FOREIGN PATENT DOCUMENTS

| | | | |
|---|---|---|---|
| 2514667 | 10/1975 | Fed. Rep. of Germany | 355/215 |
| 56-32155 | 4/1981 | Japan | 355/215 |
| 60-15667 | 1/1985 | Japan | 355/296 |
| 60-119577 | 6/1985 | Japan | 355/215 |
| 61-163362 | 7/1986 | Japan | 355/215 |

*Primary Examiner*—Fred L. Braun

*Attorney, Agent, or Firm*—William A. Henry, II

[57] ABSTRACT

A copier/printer having a transfer station for transferring images from an imaging member to copy sheets includes the improvement of removing debris from within the copier/printer by locating baffles and vacuum ports within the copier/printer to cause deposition, collection and removal of debris and other contaminants in specified locations. An electrical bias is selectively applied to at least some of the baffles to electrostatically attract the contaminants thereon. The vacuum ports are connected to a vacuum source that could operate continuously or intermittently at start-up or shutdown.

16 Claims, 1 Drawing Sheet

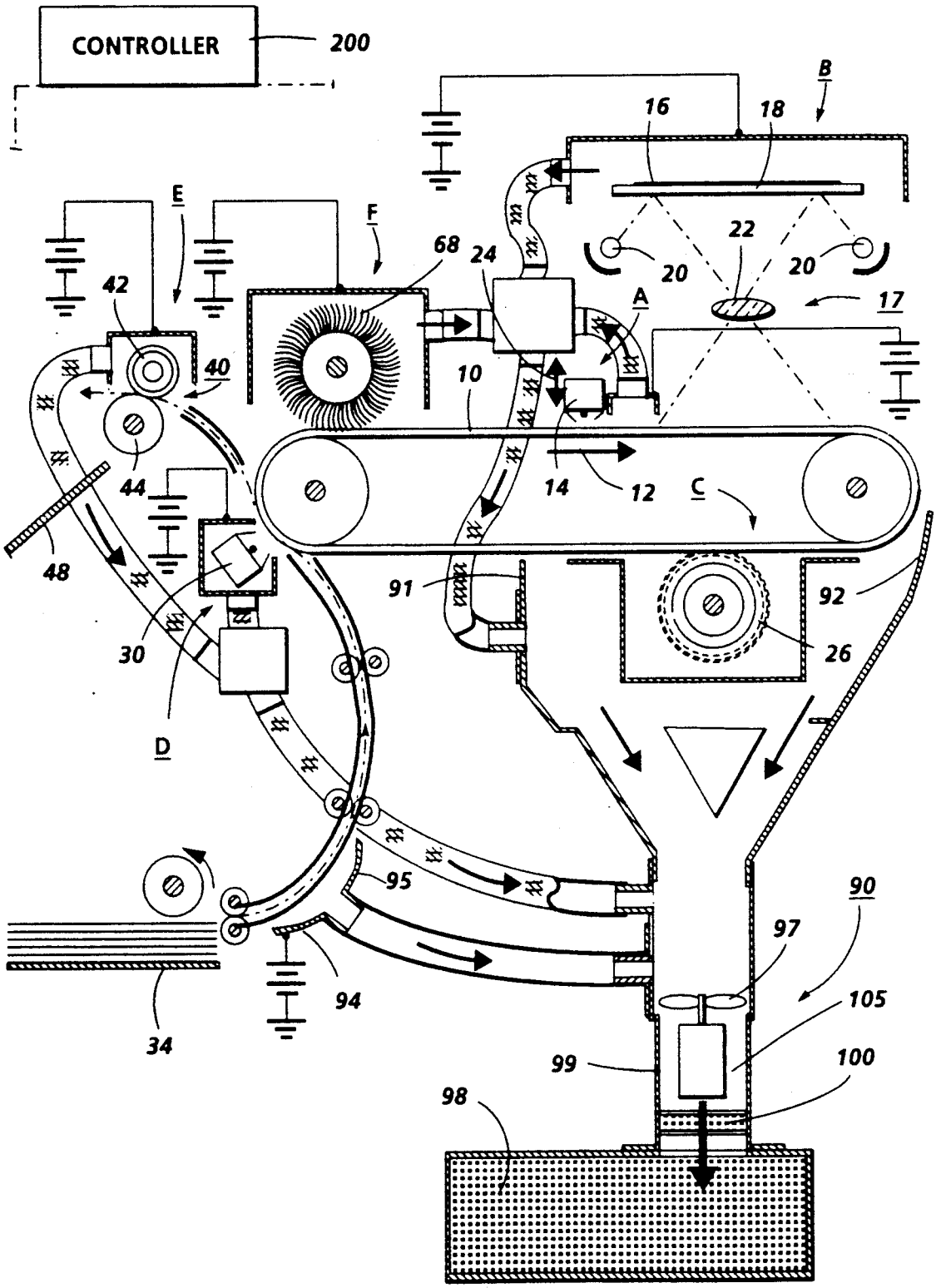
CONTROLLER
200
B
16
18
E
F
68
24
22
20
20
42
A
17
40
10
44
14
12
C
48
91
92
30
26
D
95
90
97
94
105
34
99
100
98

VACUUM COLLECTION SYSTEM FOR DIRT MANAGEMENT

This invention relates to an electrostatic copying apparatus, and more particularly, to a device for containing, collecting and removing fibers, dust toners, etc., collected on baffles in the copying apparatus prior to transfer, around various components of the copying apparatus, such as, the developer housing, etc., and also to clean drive rolls.

Electrostatic copying machines in most instances supply copy sheets of paper from a paper feed source to a transfer area for transfer of toner image to the copy sheets. During transport to the transfer area, paper particles and similar dust particles are produced by the frictional contact of the surface of the copy sheets with the peripheries of feed rollers at the feeding source and also by the frictional contact of the surfaces of the paper with the peripheries of transport roller provided in the path of transport of the paper or with the surfaces of transport guides. Also, it has been found that loose toner from the developer and cleaner housings, volatiles in the fuser area, dust in the optics cavity, as well as, ozone from the charge devices contribute to contamination within the copying apparatus and ultimately result in copy quality degradation. Loose toners, fuser volatiles and paper fibers become air borne and thus contaminate almost the entire machine.

Dust on the surface of copy sheets is attracted to the surface of photoconductors employed in electrostatic copiers when the toner saturated images on the photoconductors are transferred in the transfer area to the copy sheets. This dust is cleaned by a cleaning unit within a copier, however, when the cleaning unit employs a blade which has a forward edge that presses against the photoconductor's outer surface, dust particles tend to agglomerate at the forward edge portion of the blade member and raise the forward edge of the blade member by the agglomerated dust particles, possibly holding the blade member locally out of proper pressing contact wiht the photoconductive surface. This has a negative impact on the residual toner removing function of the blade cleaning unit. And since the toner is reclaimed to be used again, dust particles reclaimed with the toner lowers the quality of the toner and in turn the quality of the developed and transferred image. Also, dust gets attracted to drive rolls in the copier, thus reducing the friction coefficient.

Contamination due to paper debris residual toner and dust in copiers results in failure of components, copy quality degradation and blade cleaner failure, as well as drive roll loss of friction. Therefore, many attempts have been made to reduce or eliminate this contamination. For example, U.S. Pat. No. 3,850,521 teaches an electrophotographic copying apparatus that includes a cleaning station for removing residual toner from the photoconductor with a suction device equipped with a filter. U.S. Pat. No. 3,969,785 discloses a residual toner removing apparatus including a housing with a filter section followed by a suction section having a fan. A contamination control is shown in U.S. Pat. No. 4,666,282 for a Xerographic developing system including a fan and a filter. U.S. Pat. No. 4,610,534 is directed to a cleaning device for a copying machine which collects residual toner from the photoconductive surface of the machine's photoconductor and deposits the collected toner in a filter bag by a vacuum. Even though some of these methods of removing residual toner particles, dust particles and debris left in the machine from copy sheets and developer are somewhat successful, a need is still shown for a simple and economical method and apparatus for removing contaminants from inside a copier.

Accordingly, a vacuum collection system is disclosed in which baffles with and/or without a biased charge are placed in various predetermined locations within a printing apparatus and paper debris or toner contaminants are picked up by the vacuum blowers when charge is deactivated and are sent to a filter or cyclone, thereby decreasing the likelihood of decreasing copy quality or causing a malfunction of the printer. The baffles are strategically located so that any air motion will result in deposition of contaminants, similar to a "snow fence". The vacuum collection system is also attached to the illumination cavity, the fuser and to all of the charge deivces. A multi-purpose filter is included to filter ozone released from the charge devices.

The above-mentioned features and others of the invention, together with the manner of obtaining them, will best be understood by making reference to the following specification in conjunction with the accompanying drawings, wherein:

The Figure shows a schematic elevational view showing an electrophotographic copier employing the features of the present invention.

While the present invention will hereinafter be described in connection with a preferred embodiment thereof, it will be understood that it is not intended to limit the invention to that embodiment. On the contrary, it is intended to cover all alternatives, modifications and equivalents as may be included within the sprit and scope of the invention as defined by the appended claims.

For a general understanding of the features of the present invention, reference is had to the drawings. In the drawings, like reference numerals have been used throughout to designate identical elements. The Figure schematically depicts the various components of an illustrative electrophotographic copying machine incorporating the copy sheet debris collection system of the present invention therein.

Inasmuch as the art of electrophotographic copying is well known, the various processing stations employed in the copying machine of Figure will be shown hereinafter schematically and their operation described briefly with reference thereto.

As shown in the Figure, the illustrative electrophotographic machine employs a belt 10 having a photoconductive surface thereon. Preferably, the photoconductive surface is made from a selenium alloy. Belt 10 moves in the direction of arrow 12 to advance successive portions of the photoconductive surface through the various processing stations disposed about the path of movement thereof. While the electrophotographic machine shown here uses a light/lens exposure system, it should be understood that a none light/lens printing system could be used with the present invention equally well.

Initially, a portion of the photoconductive surface passes through charging station A. At charging station A, a corona generating device, indicated generally by the reference numeral 14, charges the photoconductive surface to a relatively high substantially uniform potential.

Next, the charged portion of the photoconductive surface is advanced through imaging station B. At imaging station B, a document is imaged through exposure system 17. The exposure system, indicated generally by reference numeral 17 includes lamp 20 which illuminates document 16 positioned on transparent platen 18. The light rays reflected from document 16 are transmitted through lens 22. Lens 22 focuses the light image of original document 16 onto the charged portion of the photoconductive surface of belt 10 to selectively dissipate the charge thereof. This records an electrostatic latent image on the photoconductive surface which corresponds to the information areas contained within the original document. Thereafter, belt 10 advances the electrostatic latent image recorded on the photoconductive surface to development station C. Platen 18 is mounted movably and arranged to move in the direction of arrows 24 to adjust the magnification of the original document being reproduced. Lens 22 moves in synchronism therewith so as to focus the light image of original document 16 onto the charged portions of the photoconductive surface of belt 10.

With continued reference to the Figure, at development station C, a magnetic brush developer roller, indicated generally by the reference numerals 26, advances a developer material into contact with the electrostatic latent image. The latent image attracts toner particles from the carrier granules of the developer material to form a toner powder image on the photoconductive surface of belt 10.

After the electrostatic latent image recorded on the photoconductive surface of belt 10 is developed, belt 10 advances the toner powder image past debris removal device 90 of the present invention and on to transfer station D. At transfer station D, a copy sheet is moved into contact with the toner powder image. Transfer station D includes a corona generating device 30 which sprays ions onto the backside of the copy sheet. This attracts the toner powder image from the photoconductive surface of belt 10 to the sheet. After transfer, a conveyor (not shown) advances the sheet to fusing station E. The copy sheets are fed from tray 34 to transfer station D. The tray senses the size of the copy sheets and sends an electrical signal indicative thereof to a microprocessor within a controller that controls all actions of the machine.

Fusing station E includes a fuser assembly, indicated generally by the reference numeral 40, which permanently affixes the transferred powder image to the copy sheet. Preferably, fuser assembly 40 includes a heated fuser roller 42 and backup roller 44. The sheet passes between fuser roller 42 and backup roller 44 with the powder image contacting fuser roller 42. In this manner, the powder image is permanently affixed to the sheet. After fusing, a conveyor (not shown) transports the sheets to an output tray 48.

Returning now to the operation of the printing machine, invariably after the copy sheet is separated from the photoconductive surface of belt 10, some residual toner particles remain adhering to belt 10. These residual particles are removed from the photoconductive surface thereof at cleaning station F. Cleaning station F includes a brush 68 in contact with the photoconductive surface of belt 10. These particles are cleaned from the photoconductive surface of belt 10 by the rotation of belt 10 in contact therewith. Subsequent to cleaning, a discharge lamp (not shown) floods the photoconductive surface with light to dissipate any residual electrostatic charge remaining thereon prior to the charging thereof for the next successive imaging cycle.

Turning now to an aspect of the present invention, copy sheet debris removal device 90 includes baffles 91, 92, 94, and 95 that are shown strategically placed within the copier to attract, enhance deposition and remove contaminents. As shown in FIG. 1, all of the component housings of the machine, such as, the fuser E, cleaner F, imaging station B, developer C, charge devices A and D, and baffles along the paper transport path are connected through conventional flexible tubing to a vacuum source. The baffles, housings and other devices are biased under the control of a conventional controller during the run mode of the machine to attract dirt. During start-up, no bias is applied to the various members in order to enhance the removal by the vacuum source of contaminants caught by the previously biased members. Also, because the baffles form a "snow fence", contaminants are deposited just beyond the baffles and can be picked up by the vacuum. Vacuum system 90 includes pick-ups at the baffles and various other machine component locations and at start-up, i.e., warm-up, at predetermined times when the machine is not making copies, or at the beginning or end of a new job, the vacuum blower 105 will come on for a predetermined period of time and remove contaminents. It should be understood that as many baffles or housing as desired could be used to cause deposition and remove contaminants from the machine. The contaminents are collected by a vacuum developed by a propeller fan 97 and forwarded through a multi-purpose filter 100 for the removal of ozone and other contaminants, such as, oil before being sent to the dirt filter 98 within the filter housing via air duct 99 and propeller fan 97. It will be understood that since the filter bag 98 is composed of an air filter, all of the collected debris and toner is deposited inside the air filter, while air is exhausted outside. The bearing part of the fan motor is preferably sealed to prevent clogging by passing contaminents. In addition, in order to prevent portions adjacent to the motor from being heated with the vacuum activating propeller 97 being provided in the position shown, it is possible to place the propeller closer to the developer housing C thus minimizing loss. It should be understood that the vacuum blower could be shared from a feeder other blowers needed in the machine since pick-up will only occur at a set time and for a short duration.

It should now be understood that an apparatus adapted to remove debris left from copy sheets and other comtaminents from various other locations and components within the machine has been disclosed that uses strategically placed selectively biased baffles and housings within the machine that are connected to a vacuum source which removes the debris and other contaminants from the baffles and deposits them in a filter bag.

What is claimed is:

1. In a copier/printer having a transfer station for transferring images from an imaging member to copy sheets, the improvement of removing contaminants from predetermined locations within the copier/printer including the paper path before the copy sheets reach a transfer station of the copier/printer, characterized by:

a plurality of selectively biased baffle means placed at said predetermined locations for collecting contaminants electrostatically thereon; and contaminant removal means for removing contaminants from said baffle means.

2. The improvement of claim 1, wherein said contaminant removal means includes a vacuum source.

3. The improvement of claim 2, wherein said vacuum source is ON continuously.

4. The improvement of claim 2, wherein said vacuum source is ON intermittently.

5. The improvement of claim 4, wherein said vacuum source is turned ON when the copier/printer is turned ON.

6. The improvement of claim 1, wherein said baffle means is configured to cause deposition to airborne contaminants at vacuum parts of said contaminant removal means just beyond the entrance of said baffle means.

7. In a printer apparatus having a transfer station for transferring images from a imaging member to copy sheets, the improvement of removing copy sheet debris before the copy sheets reach the transfer station and removing other contaminants from the environment of the printer apparatus, characterized by: a plurality of selectively biased baffle means positioned at different locations within the printer to attract debris and other contaminants, and vacuum pick-up means placed at said plurality of baffle means locations, said vacuum pick-up means being adapted to be actuated at predetermined times to remove debris from said baffle means.

8. The printer apparatus of claim 7, wherein said vacuum pick-up means is actuated during machine warm-up.

9. The printer apparatus of claim 7, wherein said vacuum pick-up means is actuated periodically while the printer is not making copies.

10. The printer apparatus of claim 7, wherein said vacuum pick-up means is actuated when the copier/-printing apparatus is turned ON.

11. The printer apparatus of claim 10, wherein said vacuum pick-up means is actuated after a copying sequence has been completed.

12. In a printer apparatus having a plurality of component stations for transferring images from a imaging member to copy sheets, the improvement of removing contaminants from the environment of the printer apparatus, characterized by: a plurality of selectively biased baffle means positioned at different locations within the printer to attract debris and other contaminants, and vacuum pick-up means placed at said plurality of baffle means locations, said vacuum pick-up means being adapted to be actuated at predetermined times to remove debris from said baffle means.

13. The printer apparatus of claim 12, wherein said vacuum pick-up means is connected to the plurality of component stations of the printer.

14. The printer apparatus of claim 13, wherein the plurality of component stations are selectively biased.

15. The printer apparatus of claim 12, wherein said baffle means are biased when the printer is in a run mode.

16. The printer apparatus of claim 12, wherein said baffle means is configured to cause deposition of airbone contaminants at vaccuum parts of said vacuum pick-up means just beyond the entrance of said baffle means.

* * * * *